US009205016B2

(12) United States Patent
Laflin

(10) Patent No.: US 9,205,016 B2
(45) Date of Patent: Dec. 8, 2015

(54) THERAPY APPARATUS TO RESTORE RANGE OF MOTION OF LIMBS

(76) Inventor: Sean L. Laflin, Vista, CA (US)

( * ) Notice: Subject to any disclaimer, the term of this patent is extended or adjusted under 35 U.S.C. 154(b) by 792 days.

(21) Appl. No.: 13/480,805

(22) Filed: May 25, 2012

(65) Prior Publication Data

US 2013/0317395 A1 Nov. 28, 2013

(51) Int. Cl.
*A61H 1/02* (2006.01)

(52) U.S. Cl.
CPC ..... *A61H 1/0277* (2013.01); *A61H 2201/0157* (2013.01); *A61H 2201/0161* (2013.01); *A61H 2201/0192* (2013.01); *A61H 2201/1276* (2013.01); *A61H 2201/1638* (2013.01)

(58) Field of Classification Search
CPC ..... A61H 1/0277; A61H 2201/0157; A61H 2201/1638; A61H 2201/0192; A61H 2201/1276; A61H 2201/0161; A61F 5/0125; A61F 2005/0179; A63B 21/02; A63B 21/1449
USPC ..... 601/5, 23, 24, 26, 33, 34; 602/5, 16, 20, 602/21, 23, 36; 482/112, 118, 105, 124
See application file for complete search history.

(56) References Cited

U.S. PATENT DOCUMENTS 4,606,542 A * 8/1986 Segal ..... 482/124
4,669,450 A * 6/1987 Lindberg ..... 601/33
5,087,031 A 2/1992 Hoff
5,170,682 A 12/1992 Sorensen et al.
5,213,094 A 5/1993 Bonutti
5,685,830 A 11/1997 Bonutti
5,865,770 A 2/1999 Schectman
6,120,422 A 9/2000 Kiemer
6,245,034 B1 6/2001 Bennett et al.
6,530,893 B1 3/2003 Castelli
6,537,237 B1 * 3/2003 Hopkins et al. ..... 602/5
6,669,660 B2 12/2003 Branch
6,705,974 B1 3/2004 Tardif
7,207,960 B2 4/2007 Kenney
7,235,038 B2 6/2007 Liao
7,364,555 B1 4/2008 Davidson
2006/0258965 A1 11/2006 Lee

* cited by examiner

*Primary Examiner* — Quang D Thanh
(74) *Attorney, Agent, or Firm* — Thomas A. Runk; Fulwider Patton LLP

(57) ABSTRACT

A therapy apparatus to restore range of motion to joints and limbs. The apparatus is useful for elbow joints and includes a beam on which the elbow joint rests. A tension cord extends through and beyond the length of the elongated hollow beam with a handle at the distal end of the tension cord to be grasped by the user. The proximal end of the cord is pulled by the user's other hand to rotate the elbow. A ratchet clamp forming a part of the beam retains the tension on the elbow. Since it is a ratchet clamp, the cord may be freely pulled in the proximal direction to impart more tension to the elbow, but to release the tension, the ratchet clamp must be disengaged manually. The beam has segments that are telescopically extendable and retractable to accommodate limbs of different lengths and for portability and storage.

18 Claims, 12 Drawing Sheets

THERAPY APPARATUS TO RESTORE RANGE OF MOTION OF LIMBS

BACKGROUND

The invention relates generally to a therapy apparatus and method, and more particularly to an apparatus and method for restoring range of motion to limbs. The invention is particularly useful for the elbow joint.

Physical therapy is commonly prescribed for individuals who experience pain and stiffness in their joints due to any number of causes, including highly repetitive motions performed during sporting activities or work tasks, and joints that have been immobilized for extended lengths of time due to injury. For example, tennis players, golfers, and baseball/softball pitchers engage in highly repetitive motions when playing their sport which can induce arm stress and shock that gets concentrated in the joint region and may irritate the tendons and other tissues. Hair stylists, barbers, bartenders, and industrial or assembly line employees are examples of individuals whose occupations require repetitive motions that can aggravate joints as well as surrounding tendons and muscles. Typical treatment for broken bones includes immobilization in hard casts that can lock a joint in place. Casts for broken arms can lock the elbow at a ninety-degree (90°) angle. When casts are eventually removed, sometimes three months or longer after the accident, the arm is typically very stiff and unable to move more than eighty to one-hundred degrees (80° to 100°) on account of shrunken tendons and atrophied muscles.

Traditional physical therapy can be quite expensive and time-consuming, involving travelling to a physical therapist's office for individualized stretching of the afflicted limb about the problematic joint by a trained professional to restore gradually the pre-injury range of motion. While using a professional trainer is preferable and is more likely to yield desirable results, such trainers typically give patients stretches to do at home between visits anyway. It would be desirable to provide an apparatus that enables an individual in need of physical therapy to stretch safely his or her own joint without the assistance of another.

Some apparatus, including orthotics and splints, are known in the art that may permit an individual to stretch his or her own joint and surrounding tissue, tendons, ligaments, and muscles. However, these apparatus are generally somewhat complicated with hinges, drive assemblies, springs, and the like that makes them difficult for many individuals to understand and operate properly. Some require elaborate mountings or installation that take significant space. Assembling/disassembling and installing/uninstalling can provide a level of frustration that many may not be willing to accept. Additionally, many of these apparatus are not adjustable to accommodate a plurality of users having different-sized limbs and are not easily carried and stored. Further, to the knowledge of the inventor, such prior apparatus only provide for manipulation of an elbow joint in one direction or manner. Elbow joints are more complex and therefore such prior apparatus have only limited usefulness.

It would be beneficial to provide an apparatus or "device" that is portable, and that collapses to a smaller size when not in use, and that may be easily stored away. It would also be beneficial to provide a therapy apparatus that may be used on a common flat surface, such as a table top, that is adjustable to accommodate patients' limbs of differing lengths, and that can be used to stretch different connective tissue without difficult or time consuming efforts to reconfigure the device.

In the case of elbow joints in particular, it would be beneficial to provide a therapy apparatus and method useful for providing therapy to the connective tissues associated with the elbow that provides the ability to manipulate the elbow joint in different directions or manners, that is adjustable for patients having different forearm and upper arm lengths, that can be set on a common flat surface for use, that collapses when not in use, and that is portable for the patient's use in traveling. It would also be beneficial to provide an elbow therapy device that allows for rotation of the forearm in relation to the upper arm during use so that different connective tissues may be stretched. It would also be beneficial to provide a therapy device that has a small number of parts and that may easily be operated with a single hand. Further, it would be beneficial to provide a therapy device that permits the stretching of an arm about the elbow joint of a few degrees to approximately 180°.

When a cautious approach is taken with a safety-proven apparatus that is easy to use and understand, the ability to self-direct therapy can reduce the cost and make therapy more readily and easily accessible and convenient to individuals who would not otherwise take the time and money to see a physical therapist.

Hence those skilled in the art have recognized the need for an improved therapy apparatus and method that accommodate different-sized limbs, can provide greater manipulation ability with the elbow joint so that it can be manipulated in different directions and manners, can be easily transported and stored, and allows a user to self-direct therapy and can be operated with a single hand. A need has also been recognized for a therapeutic apparatus that is relatively simple to use and easy to assemble. The present invention satisfies these and other needs.

BRIEF SUMMARY OF THE INVENTION

Briefly and in general terms there is provided a therapy apparatus and method to restore a range of motion of joints and limbs, an in particular, the elbow joint. A joint and limb In particular, there is provided a therapy apparatus for restoring range of motion of a limb about a joint, the limb having a proximal segment on one side of the joint that connects the joint to a body of a user and a distal segment on another side of the joint that is movable in relation to the joint, with an extremity at a distal end of the distal segment of the limb, the apparatus comprising an elongated beam having a proximal end and a distal end, a top and a bottom, and an inside, the bottom being flat, whereby the bottom of the beam may be placed on a flat surface for use, a joint rest located on the top of the beam, configured to receive a joint of a user, a limb segment rest formed on the top of the beam at a location proximal to the joint rest, a limb strap mounted with the limb segment rest having a size long enough to engage and immobilize a proximal segment of a limb in the limb segment rest, a cord having a proximal end and a distal end, the cord slidably disposed within the beam, the cord extending through the beam with its distal end extending beyond the distal end of the beam, the cord having a length that is greater than the length of the elongated beam such that at the same time that the cord's distal end extends beyond the distal end of the elongated beam, the proximal end of the cord also extends beyond the proximal end of the beam, an extremity-securing device attached to the distal end of the cord that moves with the cord towards and away from the distal end of the beam, the extremity-securing device configured to engage an extremity of a user that is part of a limb having a joint in the joint rest so that the engaged extremity may be pulled towards the distal end of the elongated beam by pulling the cord in the proximal direction, and a ratchet clamp mechanism forming a part of the beam and configured to clamp the cord in a selected position in relation to the beam to thereby hold the extremity-securing device and an extremity engaging that device in a selected position under tension.

In more detailed aspects, the ratchet clamp is oriented within the elongated beam such that it resists movement of the cord in the distal direction and permits movement of the cord in the proximal direction, wherein only one hand is needed to tighten the cord against a body extremity engaged by the extremity-securing device. The ratchet clamp comprises a lever mounted on the beam with a pivot, at a first side of the pivot the lever has a handle portion extending outside the beam so that it may be manipulated by a user to release the clamp, and a clamp portion at an opposite side of the pivot having a clearance with the inside of the beam that is less than the thickness of the cord, the lever being oriented within the beam wherein it rotates the clamp portion in the proximal direction when the cord is pulled in the proximal direction thereby permitting the cord to be freely pulled in the proximal direction, and when the cord is pulled in the distal direction, the lever is configured to engage the cord and rotates the clamp portion towards the top of the beam thereby clamping the cord against the inside surface of the beam to resist movement of the cord in the distal direction. In a further aspect, the clamp portion of the lever has a roughened surface to facilitate clamping engagement of the ratchet clamp with the cord.

In additional more detailed aspects, the joint rest is slidably mounted to the beam whereby users having arms of different lengths can be accommodated by the apparatus. The extremity-securing device comprises a rotatable handle thereby permitting an extremity of a user to grip the handle in a plurality of orientations. The elongated beam has a first segment and a second segment with the second segment being slidably and telescopically disposed within the first segment, whereby the second segment of the elongated beam is telescopically extendable and retractable in relation to the first beam segment.

In other detailed aspects, the therapy apparatus further comprises a locking device located in connection with the first and second beam segments to lock the segments in a selected position in relation to each other. The therapy apparatus further comprises a telescopic locking system having a movable pin biased to extend outwardly from the second beam segment, a plurality of holes formed along a length of the first beam segment, each hole having an opening large enough to receive the movable pin, whereby the first and second beam segments may be moved in relation to each other to one of a plurality of positions at which the movable pin is biased into a hole, thereby locking the second segment into a selected amount of telescopic extension or retraction in relation to the first segment.

In yet further detailed aspects, the therapy apparatus further comprises a relative position retainer disposed in a space between the first beam segment and the second beam segment, the position retainer having a thickness at least as large as the space whereby the position retainer exerts pressure on both the first beam segment and the second beam segment to hold them in a selected relative position to each other. The joint rest has a size and shape configured to receive an elbow of a user, the limb segment rest has a size and shape configured to receive an upper arm of a user, the limb strap has a length and shape configured to be placed around and immobilize the upper arm of a user in the limb segment rest, and the extremity-securing device comprises a rotatable handle having a size and shape configured to be firmly grasped by a hand of a user at a selected angle with the elbow.

In accordance with a method for restoring range of motion of an elbow with an upper arm located on one side of the elbow and a forearm located on the other side of the elbow, the method comprises positioning an elbow of a user into an elbow rest disposed along a substantially straight beam, immobilizing an upper arm of a user against a proximal section of the beam, securing a hand and a forearm of a user to a handle attached to a distal end of a cord extending through the beam, pulling a proximal end of the cord in a proximal direction through the beam and through a ratchet clamp to set a first desired level of tension on a user's hand, upon stopping the step of pulling, automatically clamping the cord in place by the ratchet clamp so that the first desired level of tension is maintained, upon pulling the cord farther in the proximal direction, automatically permitting the cord to be pulled further in the proximal direction by the ratchet clamp to set a second level of tension on a user's hand.

In accordance with more detailed method aspects, the method further comprises lengthening the beam by telescopically pulling an inner beam outwards from an outer beam to configure the beam for use in restoring range of motion of an elbow.

BRIEF DESCRIPTION OF THE DRAWINGS

FIG. 5*a* shows the clamp without the tension cord being present and the clamp in the unclamp position, FIG. 5*b* shows the tension cord present but the clamp still in a first unclamped position, and FIG. 5*c* shows the tension cord being present with the ratchet clamp in the clamped position holding the cord against movement in the distal direction but still able to permit free movement in the proximal direction to apply more tension to the cord against the user's hand, shown in FIG. 3*b;*

DETAILED DESCRIPTION OF PREFERRED EMBODIMENTS

Figure 1:
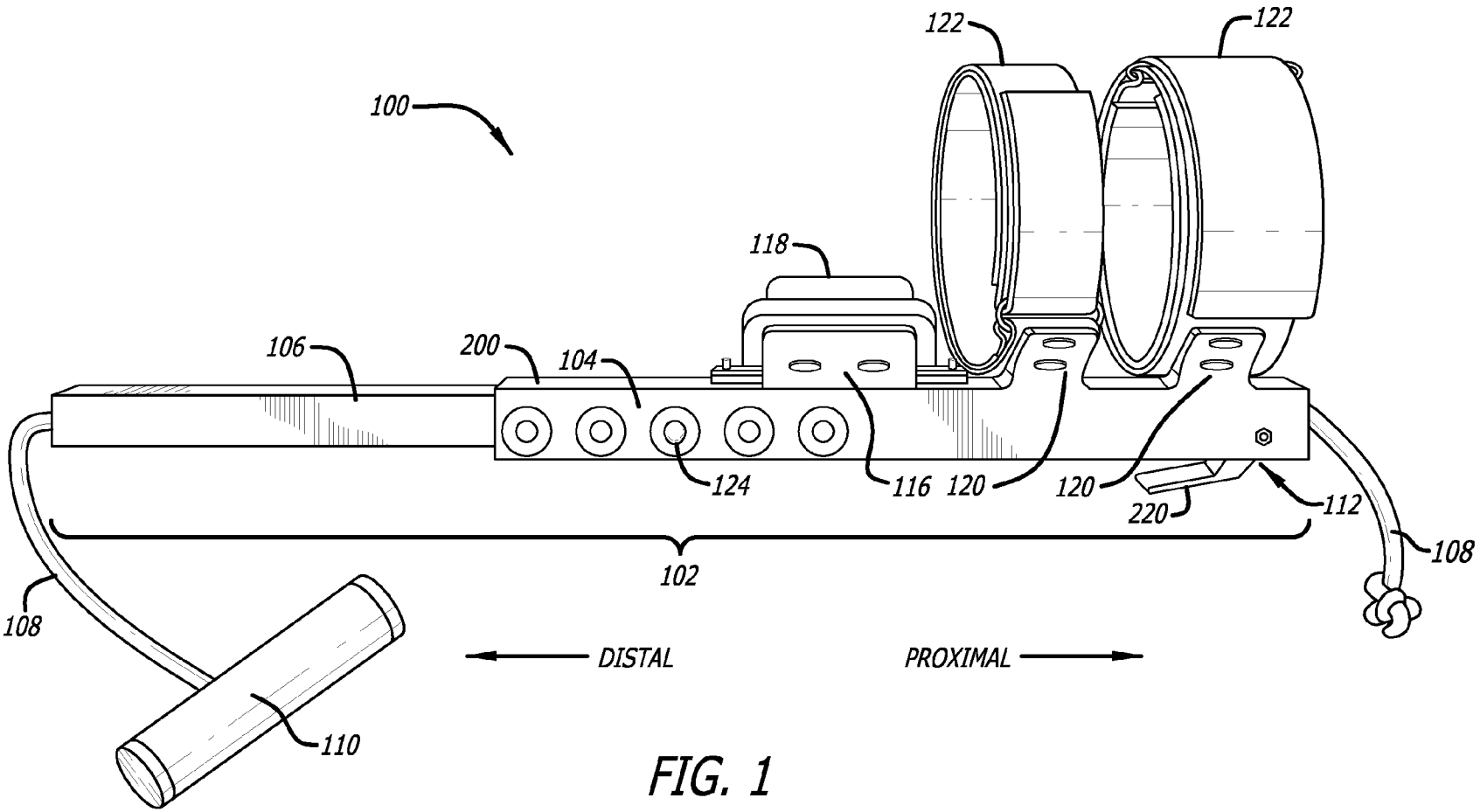
FIG. 1 is a side view of a therapy apparatus according to principles of the invention showing a telescopic beam on which is mounted a joint rest, in this case for an elbow joint, a proximal limb segment rest, in this case for an upper arm, limb straps for securing and immobilizing the upper arm to the beam, a tension cord slidably mounted through the beam, the cord having an extremity-securing device, in this case a gripping handle, attached to the distal end of the tension cord, and a ratchet clamp forming a part of the beam, in this case, near the proximal end of the beam.

Referring now in detail to the drawings in which like reference numerals indicate like or identical elements among the views, there is shown in FIG. 1 a side view of an embodiment of a therapy apparatus 100 in accordance with aspects of the invention. As shown, a beam 102 includes a hollow proximal outer beam segment 104 having a first diameter and a hollow distal inner beam segment 106 having a second diameter that is smaller than the first diameter of the proximal beam segment. In this embodiment, the distal inner beam 106 is telescopically extendable from and retractable into the proximal outer beam 104. A tension cord 108 extends through the hollow interior of both beam segments, and is secured at a selected position by a ratchet cord clamp 112 located within the proximal end of the beam 102. The cord is attached to a handle 110 at its distal end, the handle having a shape and size so that it may be firmly gripped by the hand of a user of the therapy apparatus. The handle 110 is rotatable so that the user may grip it in different forearm rotations in relation to the elbow, as is shown below.

Upon the top 200 of the proximal outer beam 104 is mounted a joint rest which, in this embodiment, is a plate 116 configured to receive an elbow joint of a user. Also mounted to the top is a limb segment rest configured to receive a limb segment of a user that connects the joint to the user's body. In this case, the limb segment rest comprises one or more plates 120 for receiving the upper arm of a user (which connects the elbow to the user's body). In this embodiment, the elbow rest plate is slidable along a portion of the top of the beam 102 to adjust its position for users having different arm lengths. The upper arm plates however are fixedly mounted in relation to the beam 102 in this embodiment. The elbow rest plate 116 is covered with an elbow pad 118 or cushion and the upper arm plates 120 are also covered with pads or cushions which are in turn connected to or are part of straps 122 or cuffs used for fixedly securing and immobilizing the upper arm of a user to the proximal end of the therapy apparatus beam 102.

Figure 2:
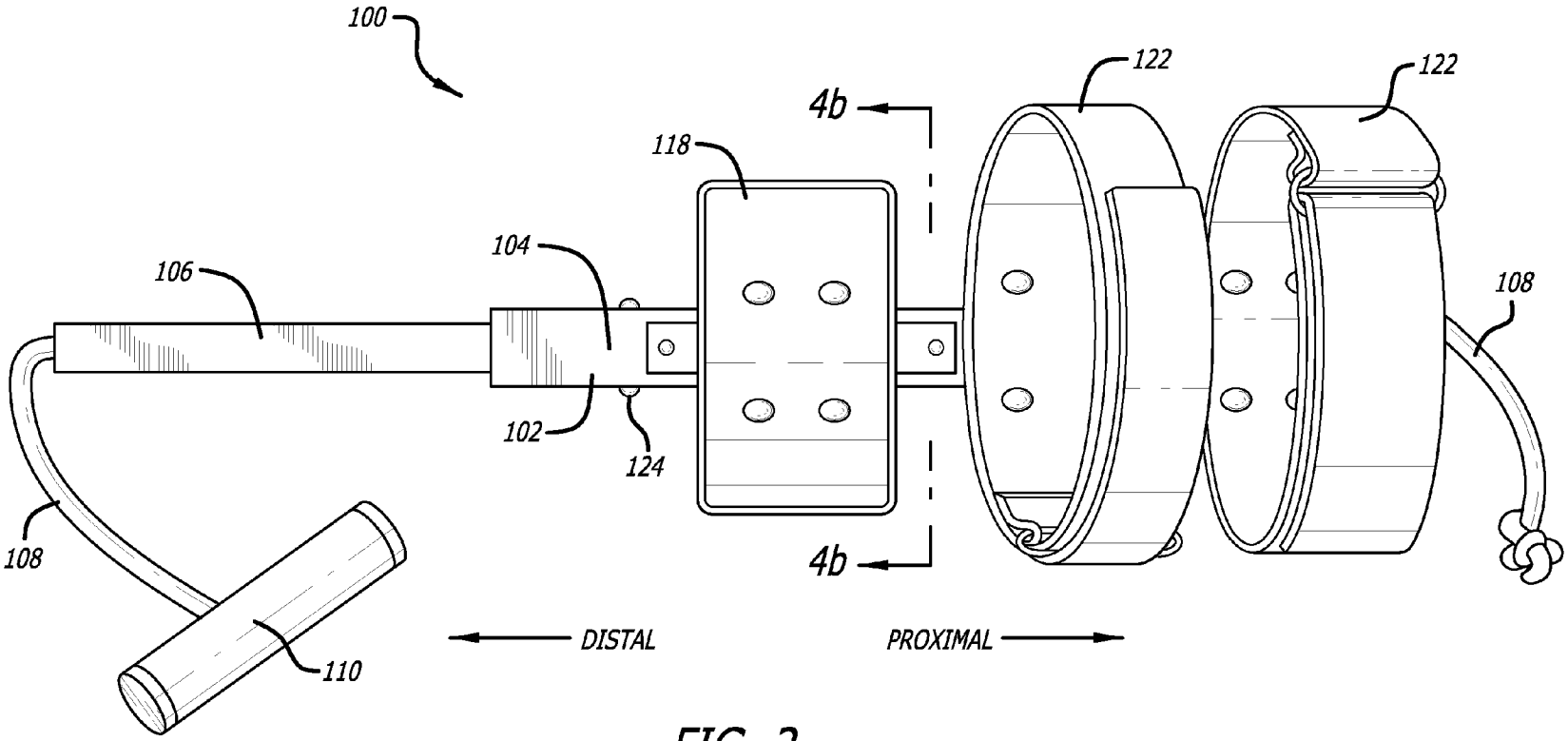
FIG. 2 is a top view of the therapy apparatus shown in FIG. 1 showing further details of the elbow rest and upper arm straps, and further showing the handle that may be gripped by the hand of a user, the handle being rotatable for turning the hand, wrist, and forearm in various rotated angles to the elbow, the figure also showing a part of a locking device that locks the inner telescopic segment of the beam to the outer segment of the beam.

FIG. 2 is a top view of the therapy apparatus shown in FIG. 1 also showing the two beam segments 104 and 106 telescoped outward in relation to one another to form the beam 102 and to more closely match the length of a user's arm, as will be shown in FIG. 3. Also, FIG. 2 shows the elbow rest plate having a pad 118 on which a user's elbow may more comfortably rest when using the therapy apparatus 100. In this embodiment, the pad is held to the rest plate with either bolts or screws and oversize washers, although other fasteners, including adhesive, may be used. In FIG. 2, the upper arm straps 122 are shown in their closed positions at which they may securely immobilize the upper arm of a user in relation to the beam thereby allowing only the therapeutic movement of the forearm and elbow relative to the beam.

Figure 3A:
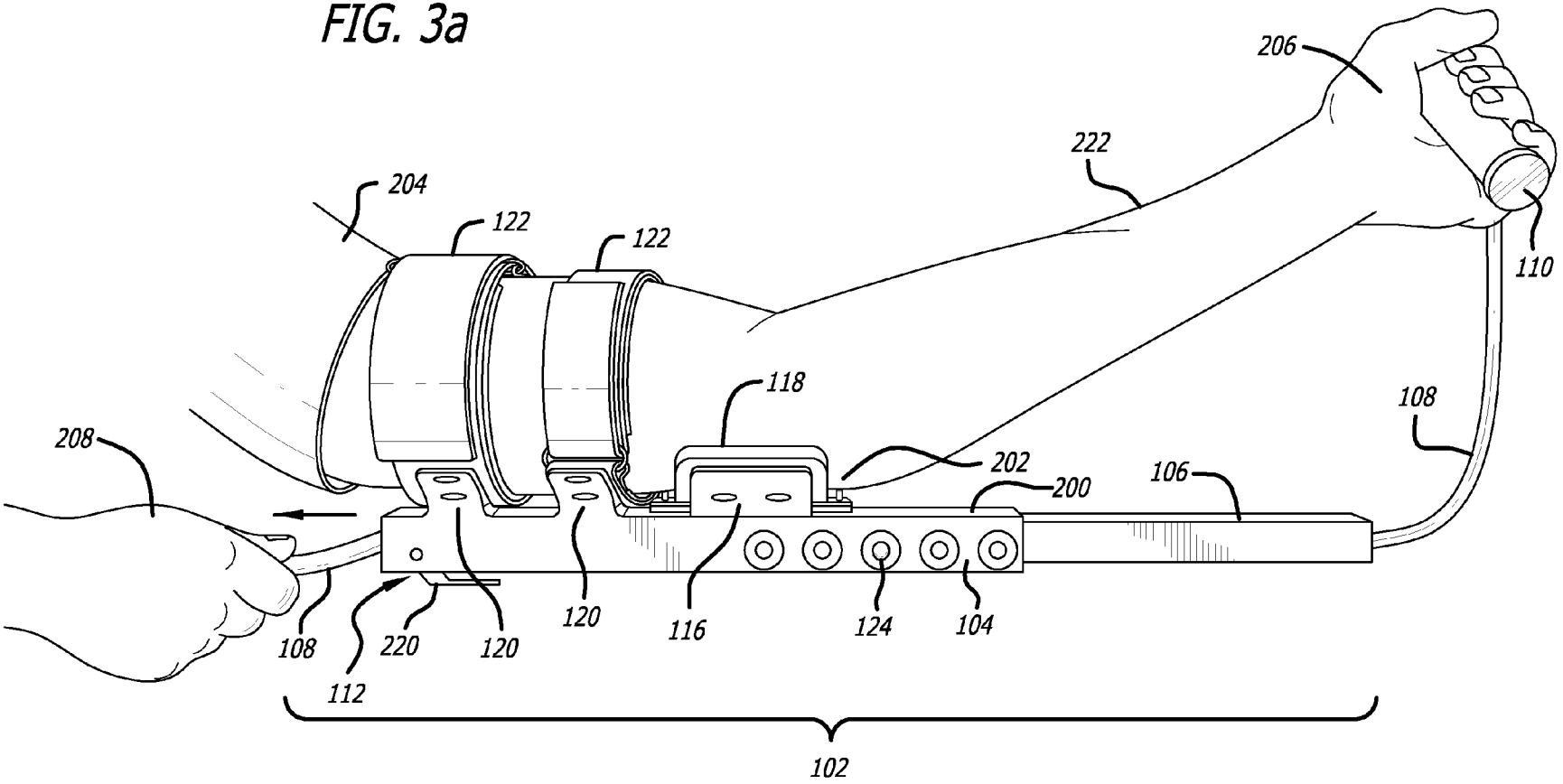
FIGS. 3*a* and 3*b* are side perspective views of the therapy apparatus of FIG. 1 that has been engaged by the arm of a user for the purpose of restoring a range of motion of the arm about the elbow joint with FIG. 3*a* showing the tension cord loose and not applying any stretching tension to the hand, wrist, and forearm, and with FIG. 3*b* showing that tension has been applied to the cord thereby tending to move the forearm downward towards the beam, and further showing that the beam has a flat bottom surface enabling use of the apparatus upon a flat surface in many locations.
Figure 3B:
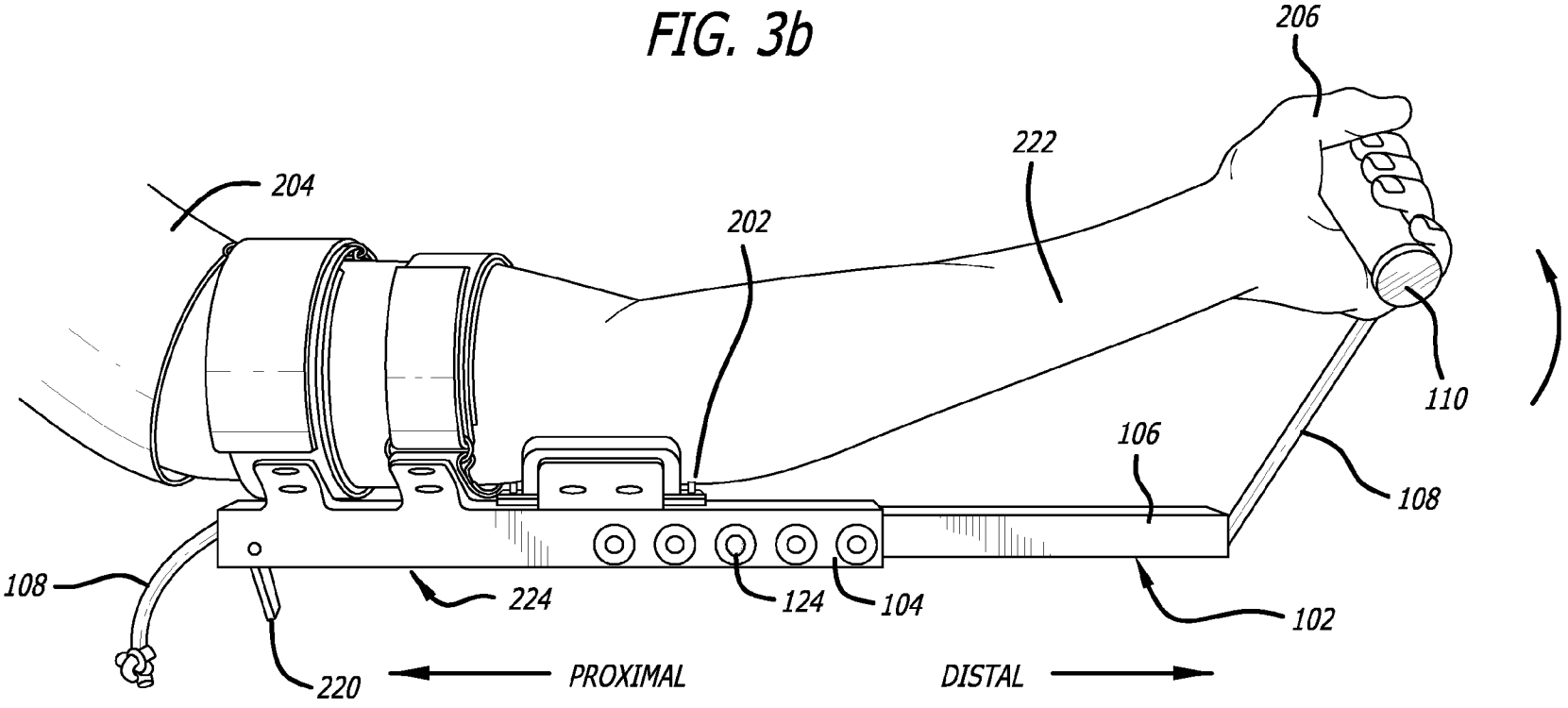

Turning now to FIGS. 3*a* and 3*b*, a side view of the therapy apparatus 100 of FIG. 1 is shown as it would be used for therapy on an elbow 202. FIG. 3*a* illustrates the arm in a first position without tension in the cord 108 while FIG. 3*b* illustrates the arm in a second position with tension in the cord 108, the second position being a position that straightens and stretches the arm. In this case, the left elbow of a user is undergoing therapy and although not straightened all the way to 180°, the user's arm is getting close to that amount of straightening. In more detail, the user's upper arm 204 is secured to the beam 102 by means of two straps 122, each of which is mounted to an upper arm plate 120 or rest. The user's elbow 202 is resting on a pad 118 mounted to the elbow rest plate 116. The user's left hand 206 is gripping the handle 110 that is connected to the tension cord 108. The user's right hand 208 is pulling the proximal end of the tension cord to apply force to pull the user's left hand downward to the beam 102.

In this embodiment, the handle 110 is a cylindrical or solid length of rigid material, such as wood or plastic, but other shapes and materials may be used. A less solid, or resilient material may be used for the handle. The tension cord 108 is attached to the handle at approximately its center, although other points of attachment and ways of attachment may be used. As an overview, the handle may be of any style, shape, and size so long as it permits an extremity (e.g. hand or foot) of the limb being treated to be securely engaged by it and pulled by it, thereby providing tension in the cord. According to the embodiment shown above in which the elbow joint of an arm is being stretched, the handle is a cylindrical structure configured for the hand to wrap around. Other embodiments for the handle are a glove or rings for the fingers. If the knee joint of the leg is to be stretched, the handle can be a shoe, sandal, or a structure that fits between the big toe and the adjacent toe, or may have other configurations.

One desirable feature of the handle in accordance with the various embodiments of the present invention is that it permits the hand to be freely rotated to provide different stretches in different configurations: palm up, palm sideways (rotated 90 degrees), palm down (rotated 180 degrees), and other positions in between these. The relative positions of the bones (e.g. radius, ulna), muscles, ligaments, tendons, and other anatomic elements change as the orientation of the hand holding the handle changes. One embodiment that achieves this desirable feature is a handle mounted to the stretching device through a cord disposed between the two ends of the handle. The distal end of the cord is anchored to the handle such that a user grasping the handle can perform stretching exercises with the hand in different orientations.

Thus, the beam 102 provides a sturdy foundation for therapy in restoring a range of movement of a limb. In the case of FIG. 3*a* and FIG. 3*b*, the therapy apparatus 100 is used to rotate the elbow of the user by pulling the arm downwards towards the beam. It will be noted that the arm in both FIGS. 3*a* and 3*b* is secured to the beam on one side of the joint (elbow) while the other part of the limb (forearm and extremity, i.e., hand) can be rotated by means of the tension cord and handle. If the joint being rotated were a knee, a foot or ankle device may be used to secure the lower part of the leg to the tension cord, while the thigh would be fixed in relation to the beam. The lower part of the leg would be pulled towards the beam to rotate the knee and cause the tissues to stretch to restore a satisfactory range of movement.

The lever handle 220 of the ratchet clamp 112 is shown in the engaged position in FIG. 3*b* at which the clamp does not oppose movement of the tension cord 108 in the proximal direction but opposes movement of the tension cord in the distal direction. In that regard, it acts in a ratchet fashion. In the configuration shown in FIG. 3*a*, the right hand 208 of the user can be removed from the tension cord 108 and the cord will remain in the position as shown in FIG. 3*b*, continuing to apply the downward tension to the user's lower arm 222. In accordance with a feature of the present clamp, the more the user attempts to move his or her lower arm away from the beam 102, the more clamping force is automatically applied to the cord 108 to maintain it in its present position by the ratchet clamp 112.

To release the tension on the cord 108, such as when another repetition of the stretching therapy is needed, or the therapy session is over, the user must push the lever handle 220 of the clamp 112 towards the bottom 224 of the beam 102 as shown in FIG. 3*a* which will then mechanically disengage the clamp from the tension cord. The cord will then freely move in the distal direction and the user can then bend his or her arm up to 90° or other selected angle. The cord 108 may be braided or double braided and formed of nylon, polyester, steel cable, or other materials.

Figure 4:
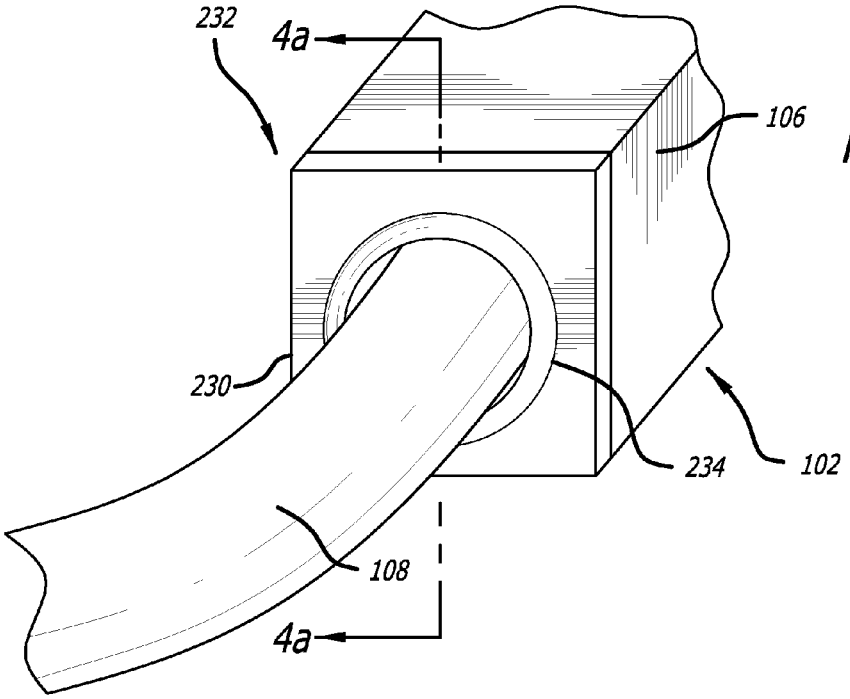
FIG. 4 is a partial front perspective view of the therapy apparatus of FIG. 1 showing a centering grommet or aperture formed in the distal end of the beam through which the cord slides into and out of the beam at its distal end.
Figure 4A:
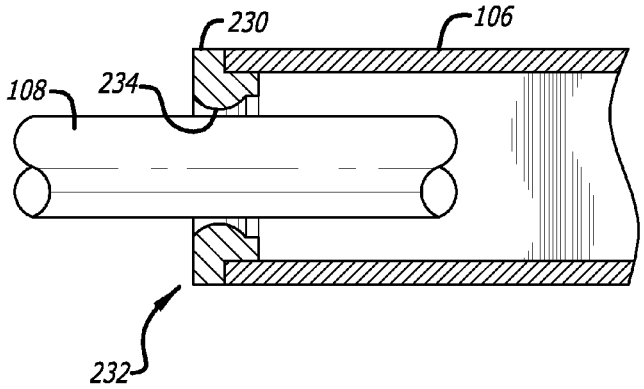
FIG. 4*a* is a side cross-sectional view of FIG. 4.

FIG. 4 is a front view of the beam 102 showing an end cap 230 or other device formed into the distal end 232 of the beam 102. This end cap includes a circular opening 234 that is centered in the distal end of the beam and acts as a grommet to guide the cord 108 through the center of the opening. The object is to provide a smooth sliding surface to the cord because the angle of the cord leaving the distal end of the beam connecting to the handle may be at a 90° or greater angle and the cord may tend to bind against a non-slippery edge of the distal opening of the beam if the grommet were not present. Different means may be used to accomplish this smooth sliding surface for the cord at the distal end. An insert plastic grommet may be held within the distal end with adhesive or other means. The grommet may have a cap that surrounds the end edges of the beam as well as providing a central aperture through which the cord may slide. The grommet must be sturdy enough to withstand sliding pressures from the cord in the axial direction as well as pressures from the cord exerted in radial or angular directions. The central aperture of the end cap may be funnel shaped or rounded as shown in FIG. 4*a* and the end cap may be press fit onto the distal end of the beam.

Figure 4B:
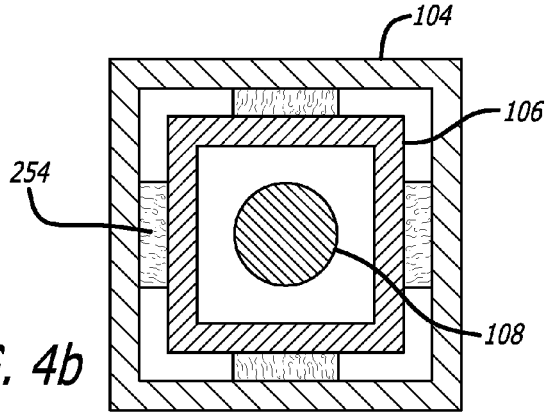
FIG. 4*b* is a front cross-sectional view of FIG. 4 also showing the telescopic nature of the beam of FIG. 1 showing the outer beam and the inner beam with a space filler located between the two that provides stability to the beam.

As shown in FIG. 4*b*, between the proximal outer beam 104, which is positioned below the upper arm when a user stretches with the device and the distal inner beam 106, which is positioned below the forearm in operation, a space filler 254 may be provided to prevent instability or wobbling of the two beams in relation to each other and to eliminate noisy clanking between the larger outer beam and the smaller inner beam during use, telescopic extension and telescopic retraction. For example, the space filler may be, but is not limited to, washers, a fluorocarbon polymer with slippery, nonsticking properties including polytetrafluoroethylene or TEFLON™, or a piece of fabric having a dense nylon pile thereon such as female VELCRO™ material.

The space filler 254 may also function as a relative position retainer. The relative position retainer is disposed in the space between the outer surface of the inner beam 106 and the inner surface of the outer beam 104. The thickness of the position retainer 254 may be less than, equal to, or greater than the space between the beam segments 104 and 106. When the thickness of the spacer is greater than the space between the two beam segments, the spacer functions to exert pressure against both of the beam segments surfaces to hold them in a selected relative position to each other. The relative position retainer may be formed of any friction enhancing, noise dampening material that also permits smooth gliding of the beams relative to each other when one beam is pushed or pulled relative to the other. The relative position retainer may be secured through adhesive to the inner surface of the outer beam or to the outer surface of the inner beam.

Figure 5A:
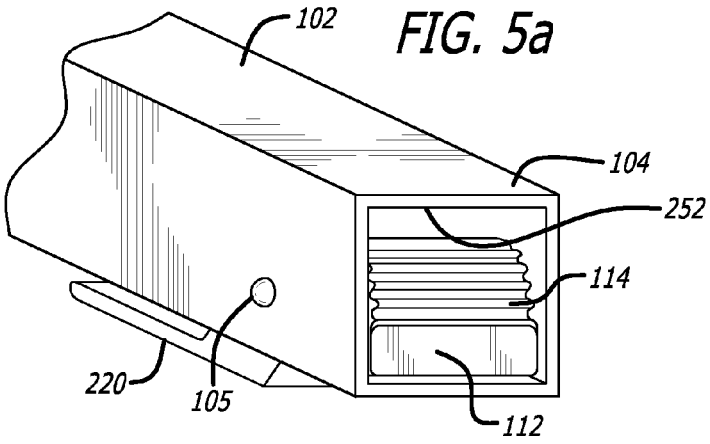
FIGS. 5*a*-5*c* are rear views of the therapy apparatus of FIG. 1 showing the operation of a ratchet clamp that allows the tension cord to be freely pulled through the clamp in the proximal direction but which automatically resists movement of the cord in the distal direction unless the clamp has been released. In particular.
Figure 5B:
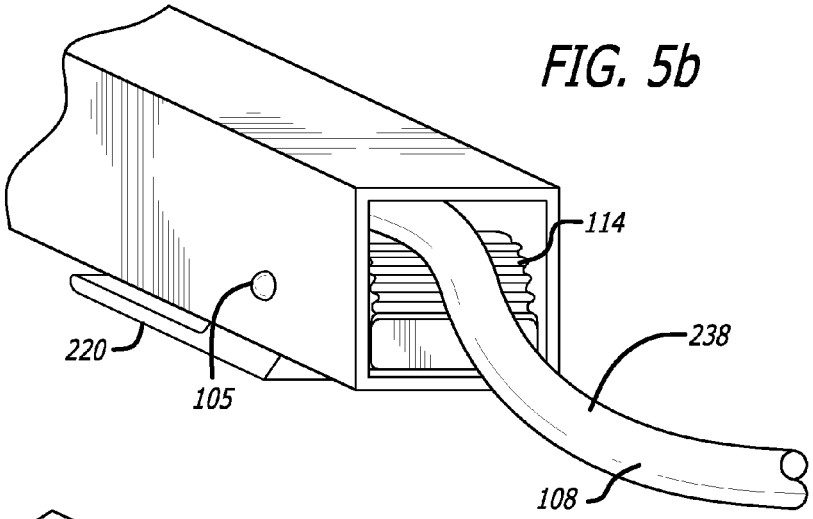
Figure 5C:
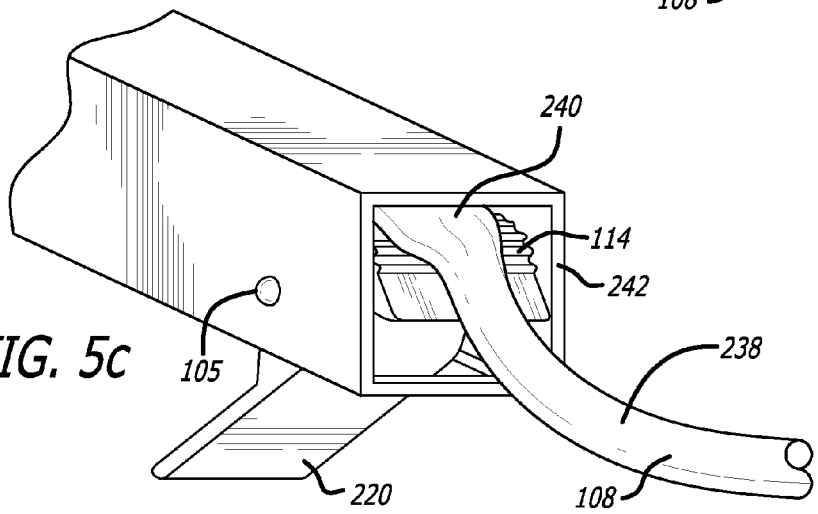

FIGS. 5*a*, 5*b*, and 5*c* are back views of the beam 102 with the limb rest and straps (see FIG. 1) removed. The ratchet clamp 112 that is in the engaged position with the tension cord 108. The portion 238 of the cord 108 outside the beam is fairly circular while the flattened cord portion 240 at the position within the proximal end 242 of the beam is fairly flat due to the pressure exerted against it by the clamp 112. A lever handle portion 220 is part of the clamp and is used to engage the clamp with the cord and to disengage the clamp with the cord. The pivot pin 105 for the operation of the clamp is shown on the side of the beam. The pivot pin goes from side to side through the beam and also goes through the lever to provide it with the desired motion. More detail regarding such a cord clamp is presented below. At the back end 242 of the beam, the cord 108 extends beyond the beam by a selected distance so that it may easily be grasped and pulled in the proximal direction to apply tension to the distal end of the cord connected with the handle 110, (see FIG. 3*a*) to pull the user's arm towards the beam.

Figure 6:
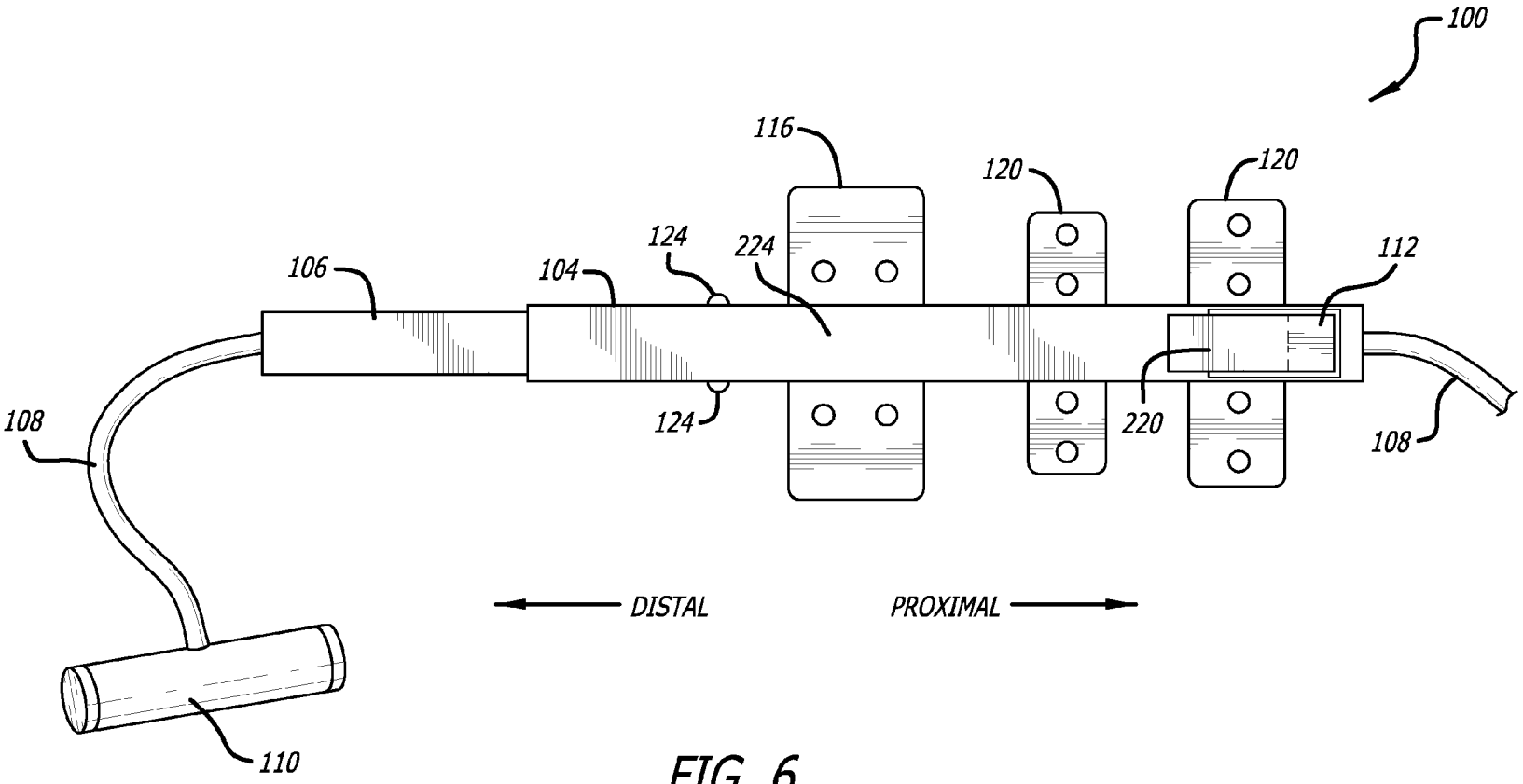
FIG. 6 is a bottom view of the therapy apparatus of FIG. 1 showing more clearly the adjustment and locking pins that are used to set the length of telescope of the beam, as well as further detail of the elbow rest and upper arm straps, and the lever handle of the ratchet clamp.

FIG. 6 is a bottom view of the therapy apparatus 100 shown in FIG. 1 and more clearly shows further detail of the lever portion 220 of the ratchet clamp 112 and the telescopic beam lock devices 124. In this view the elbow rest plate 116 and two arm rest plates 120 are more clearly illustrated with screw heads that are used to anchor pads and straps to the respective plates. The ratchet clamp 112 for holding the tension cord 108 in a selected position is shown with the clamp lever handle portion 220 pivoted to be positioned against the bottom 224 of the beam 102, which disengages it from the tension cord 108. In this position, the tension cord can freely slide in both the distal and proximal directions. This configuration allows easier storage and transport of the therapy apparatus 100. Also more clearly shown is the telescopic nature of this embodiment of the beam. Consistent with the previous description, the beam comprises a proximal beam segment 104 and a distal beam segment 106 that is extended from the proximal beam segment to make the beam longer. A locking device or mechanism comprising an opposing pair of spring-loaded pins 124 is used to lock the two beam segments in a selected position in relation to each other, whether retracted or extended. In FIG. 6, two pins 124 of that locking device or mechanism are shown protruding through the proximal beam segment thereby locking the two beam segments in fixed relative positions. More detail is provided below.

Figure 7:
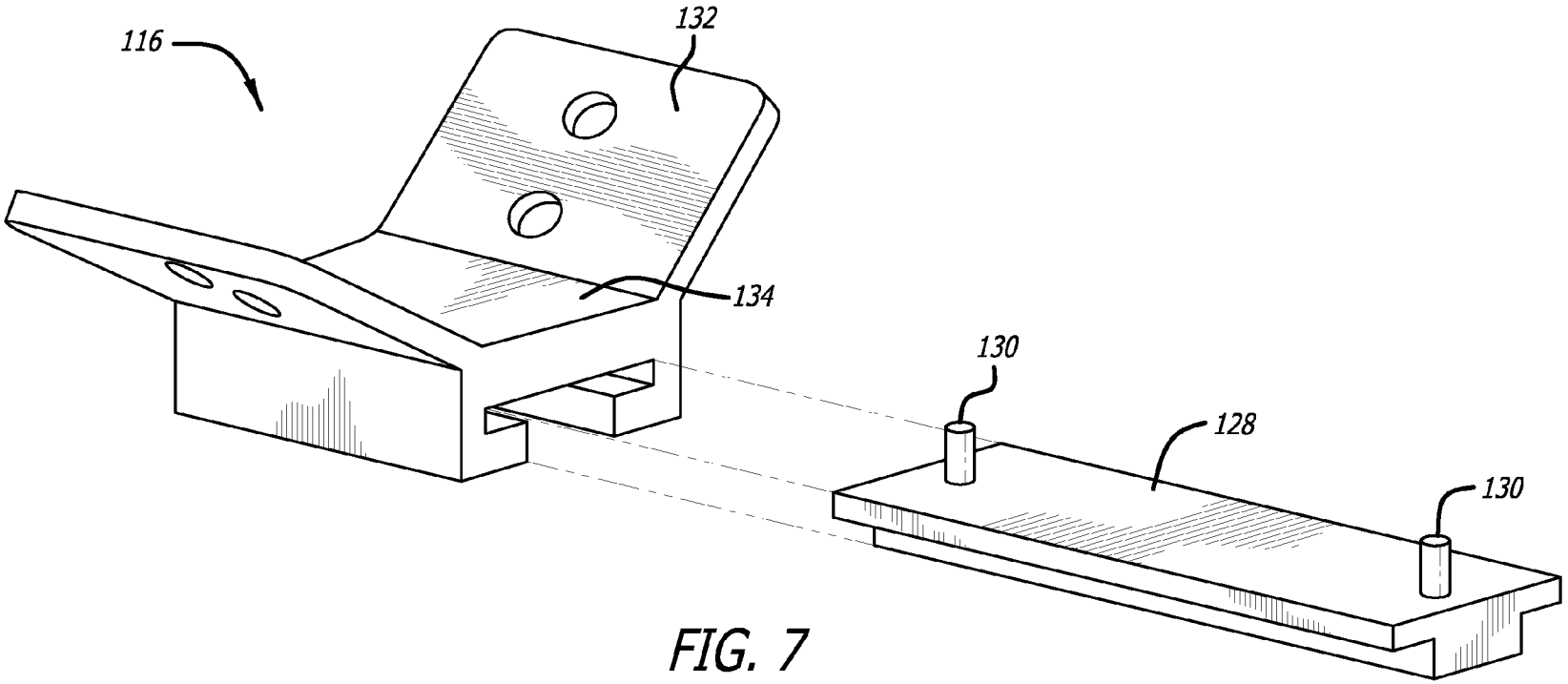
FIG. 7 is a close-up exploded perspective view of the sliding elbow rest plate shown in FIGS. 1 and 2 having a rail that is mounted to the top surface of the outer beam with stop pins positioned at either end of the rail to limit the range of sliding movement of the rest plate.

FIG. 7 is an isolated, close-up, perspective view of the sliding elbow rest 116. The sliding elbow plate 116 includes a flat base 134 and symmetrical side walls 132 extending upwards and outwards therefrom to guide and receive the joint (in this case an elbow) of a user of the therapy apparatus into the elbow rest. In this embodiment, the sliding elbow plate is slidably mounted on a guide rail 128, the guide rail in turn being fixedly mounted on the top surface of the beam 102 (not shown). The elbow plate 116 can move back and forth between raised pins 130 on the guide rail 128 to adjust to the length of the user's arm, which serve to act as stops and limit the sliding movement range of the elbow plate. In this manner, the therapy apparatus is able to accommodate different lengths of arms of different users. The elbow plate 116 can slide freely between raised pins 130 on guide rail 128 until a comfortable position is obtained.

Figure 8A:
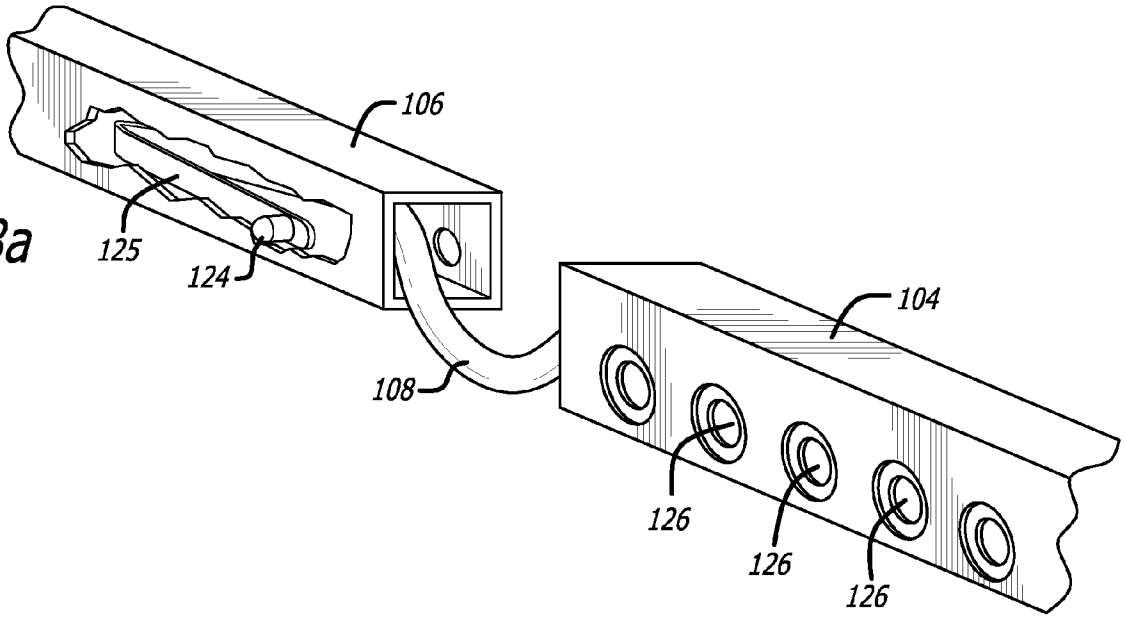
FIGS. 8*a* and 8*b* show further details of an embodiment of the telescopic construction of the beam that includes a series of locking holes in the outer beam segment into which spring-loaded pins in the inner beam segment extend to lock the two beam segments with each other when the distance of telescopic beam length is selected, FIG. 8*a* providing a perspective view looking in the distal direction with a partial cutaway of the distal segment of the beam, and FIG. 8*b* providing a top cross-sectional view of the construction of the pins that are used to lock the beam segments together.
Figure 8B:
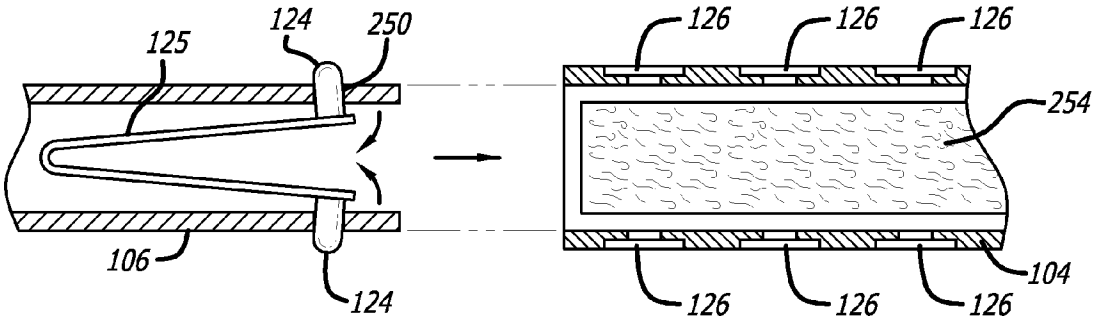

FIGS. 8*a* and 8*b* comprises a pair of drawings with FIG. 8*a* showing an exploded, perspective view. The distal inner beam segment 106 is shown completely disengaged from the proximal outer beam segment 104 in this exploded view. The tension cord 108 passes through the interior of each beam segment. A spring-loaded pin 124 extends from the inner surface of the inner beam segment 106 and is configured to mate with and protrude through any one of the plurality of locking holes 126 on the surface of proximal outer beam segment 104. The hole 126 selected by the user for the pin 124 to fit through will change the total functional length of the beam 102 by increasing or decreasing the length along which the two beam segments 104, 106 overlap. Accordingly, the beam 102 is designed to fit arms having a variety of lengths.

FIG. 8*b* is a cross-section exploded side view showing how a plurality of opposing pins 124 extend from the inner beam segment and are mounted on a V-shaped or U-shaped runner 125 that comes to an apex at one end farthest from the pins where it curves. According to an alternative embodiment, each pin on each side of the beam may be mounted on its own respective runner that extends along the interior of the inner beam segment and is secured to a side wall thereof with adhesive. In this embodiment, that adhesive is applied only to the portion of the runner that is opposite the pin end. The runner is made of flexible material and by attaching on the runner end to the surface of the beam, the pin 124 will be effectively spring loaded into the hole 250 of the inner beam segment 104. If the pin 124 is pressed down, the smaller diameter inner beam 106 can be telescopically inserted within the larger diameter outer beam 104. As the inner beam 106 is slid inside the outer beam 104, the pin will automatically deploy through the first hole 126 of the outer beam 104 as it passes. When the pins 124 are deployed through any of the holes 126, the functional length of the total beam 102 is then locked. However, the pins 124 can be pressed down into the outer beam hole and the inner and outer beams can again be repositioned in relation to one another. In this embodiment, two opposing pins are used to result in a more stable and robust telescopic beam. However, other configurations are possible.

Figure 9A:
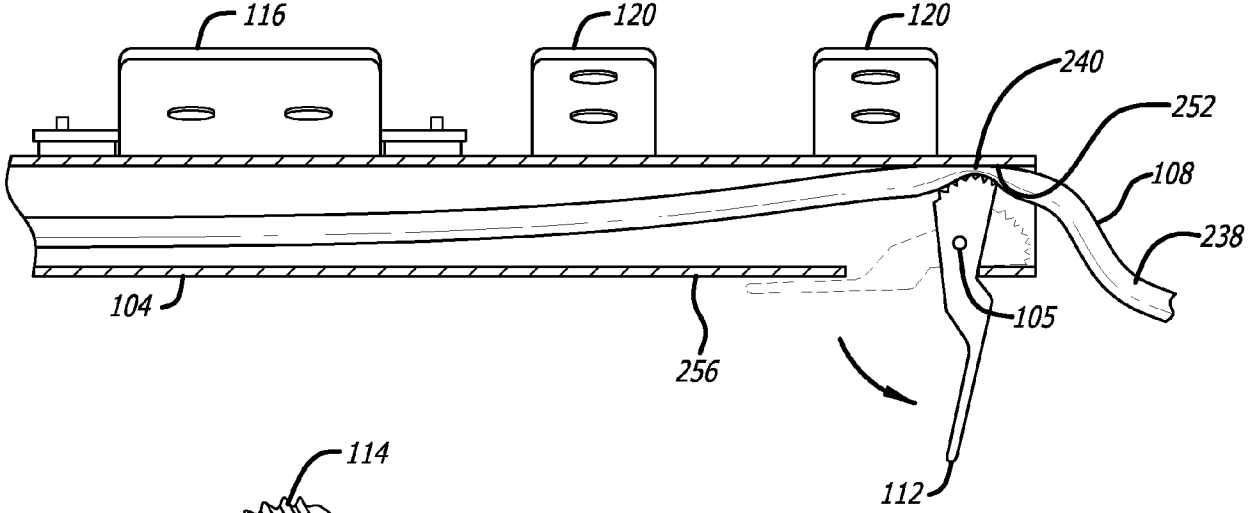
FIGS. 9*a*, 9*b*, and 9*c* show various views of an embodiment of a ratchet clamp for the tension cord according to principles of the invention, including a cross-sectional side view (FIG. 9*a*) showing the clamp engaged with the cord and preventing its movement in the distal direction while allowing free movement in the proximal direction, an isolated side perspective view of the clamp showing its handle and clamp segments (FIG. 9*b*), and an isolated perspective rear view of the beam without the clamp showing the holes formed in the beam to accept a pivot pin for the clamp lever (FIG. 9*c*)
Figure 9B:
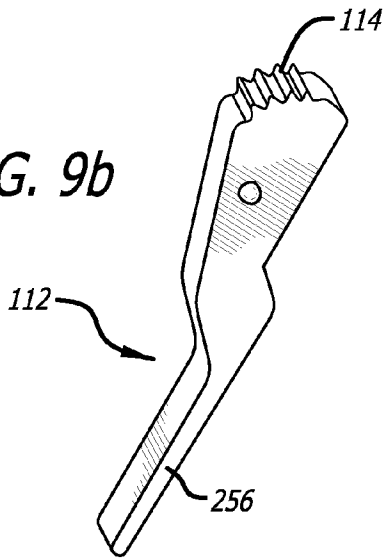
Figure 9C:
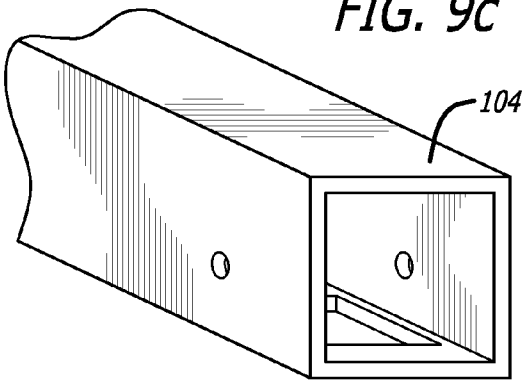

FIGS. 9*a*, 9*b*, and 9*c* form a collection of three figures illustrating a ratchet clamp for clamping the tension cord in a particular place. In this case, the ratchet clamp comprises a lever mounted so as to pivot inside the first hollow beam segment 104. It will be seen from FIG. 9*a* that the top inside beam surface is used as a clamping surface or anvil against which the lever presses the tension cord to hold it in a selected position. The ratchet clamp lever comprises a lever handle portion that may be manipulated by a user, and a lever clamp portion that presses against the tension cord. The clamp portion has a roughened surface.

In particular, FIG. 9*a* shows a cross-section side view of the proximal segment 104 of the beam 102, illustrating the tension cord 108 passing through the ratchet clamp 112 and extending out from the rear (proximal end) of the beam segment 104. On the top 200 of the outer surface of the outer beam 104 are arm rest plates 120 and a slidably mounted elbow rest plate 116. FIG. 9*a* shows the lever 220 of the clamp in the engaged position with the tension cord being clamped against the inside of the beam. In this view, the clamp portion of the lever 112 is pressing the cord against the top inside surface 252 of the beam segment. Because the pivot pin 105 is to the left of the clamping position of the lever with the cord, further pulling action on the cord in the distal direction will cause the lever to more tightly clamp the cord to the inside surface of the beam. However for that same reason, a pulling force on the tension cord in the proximal direction will move the clamp portion also to pivot in the proximal direction permitting the tension cord to move in the proximal direction. Thus, the clamp operates as a one-way clamp or ratchet.

FIG. 9*b* is an embodiment of a lever 220 that is used for the cord ratchet clamp 112 to press the cord against an inner surface of the outer beam 104, as shown in FIG. 9A. The lever clamping portion has a roughened surface 114 enabling it to more firmly grip the cord for clamping purposes. In this case, the roughening takes the form of a plurality of indentations or grooves therein that create friction when pressed into the cord to more securely engage with the cord. Other types of surface roughening may be used.

FIG. 9*c* is a rear perspective view of the proximal end of the outer beam segment 104 illustrating aligned holes through the side walls for accepting a pivot pin that can be passed through the lever of FIG. 9*b* for form the ratchet clamp 112. The figure also shows an opening in the bottom of the beam segment that accepts the handle portion 256 of the lever so that it can pivot to result in the clamping action.

In one embodiment, the length of the clamping portion of the lever 220 between the pivot pin 105 and the clamping surface 252 (inside surface) of the beam is longer than the distance between the pivot pin 105 and the top inside surface of the beam segment. Thus, even if there is no tension cord 108 in the beam segment, the clamping portion of the lever cannot be pivoted far enough so that its ends up in a distal position to the pivot pin. This feature makes the clamp a ratchet clamp that enables a user to self-direct his or her own therapy. With this design, all the therapy can be performed with just one hand. There is no need for the user to release the tension cord and disengage the clamp to apply more tension to the arm undergoing therapy. The ratchet clamp shown and described herein permits the user to pull more tension on the cord (pull it in the proximal direction) with his/her loose hand. If the therapy set is over, the user can release the ratchet clamp by moving the handle portion of the clamp lever in the distal direction thereby causing the clamping portion of the ratchet clamp lever to move in the proximal direction and release the cord.

Figure 10:
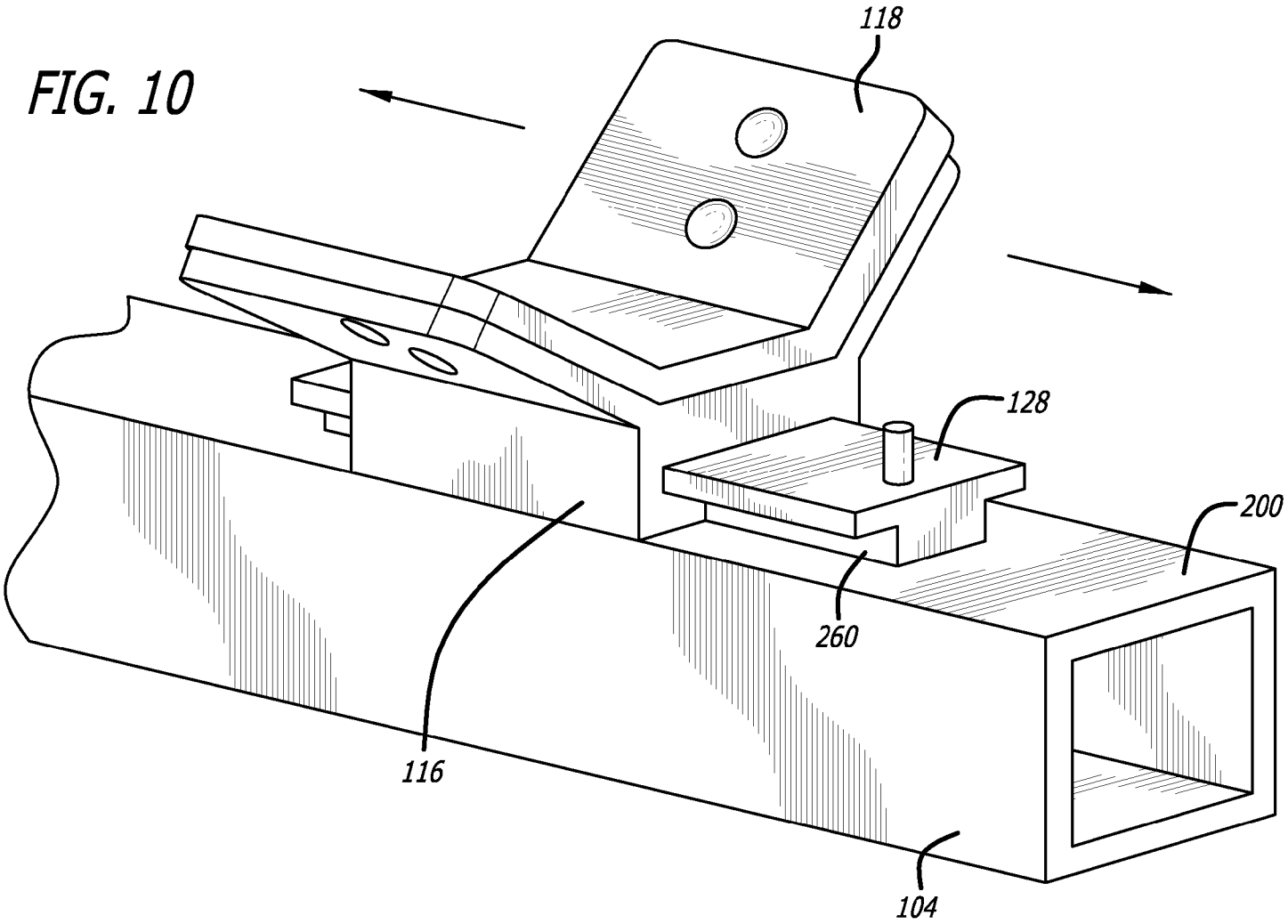
FIG. 10 is a perspective view of the elbow rest showing that in this embodiment, its base on which the rail is formed, is welded to the beam, and also showing padding mounted to the rest plate.

FIG. 10 is a perspective view of the outer beam segment 104 illustrating the joint rest 116 slidably mounted to the top of a guide rail 128 that is welded 260 to the top 200 of the outer beam segment 104, in this embodiment. Padding 118 is shown fixedly mounted to the top surface of the joint rest.

Figure 11B:
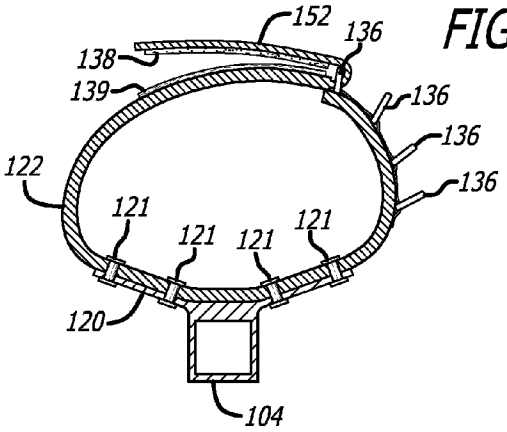
FIGS. 11*a*, 11*b*, 11*c*, and 11*d* show various views of embodiments of upper arm cuffs or straps including a vertical side view of a rolled cuff (FIG. 11*a*), a rear or front view of a rolled cuff (FIG. 11*b*), an unrolled or laid-out view of the inside of a cuff (FIG. 11*c*), and an unrolled or laid-out view of the outside of a cuff (FIG. 11*d*).
Figure 11A:
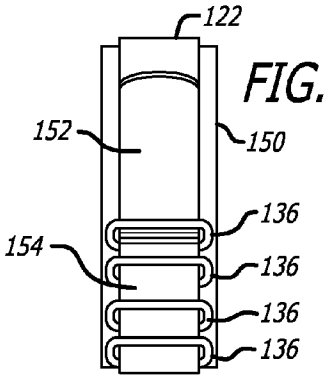
Figure 11C:
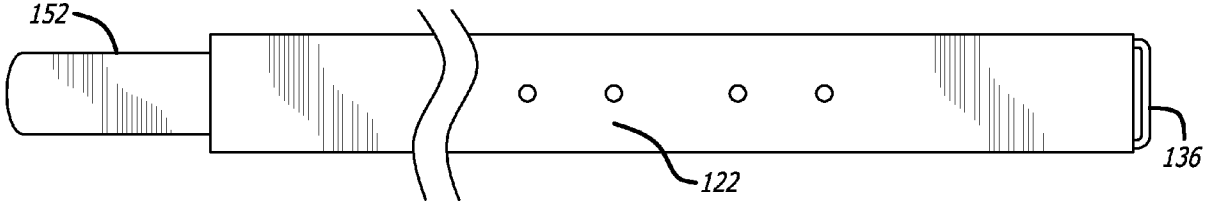
Figure 11D:
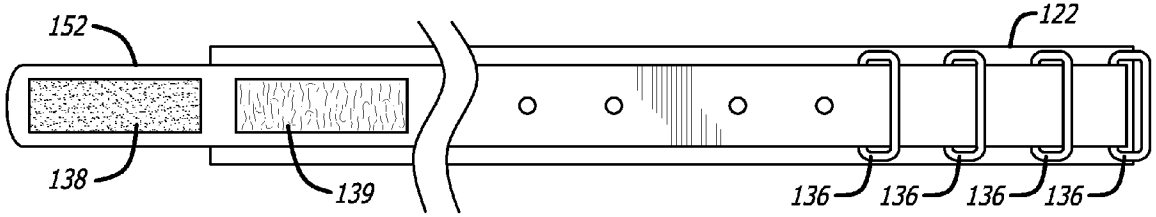

FIGS. 11*a*, 11*b*, 11*c*, and 11*d* form a group of related drawings showing different views of limb straps 122 or cuffs that are secured to the limb rest plates 120 of the outer beam segment 104 from various perspectives. FIG. 11*a* is a side view of a cuff alone and FIG. 11*b* is a rear view looking along the axis of the first beam segment 104 along which an arm extends as it fits through the cuff. FIG. 11*c* is an inside view of an unrolled arm cuff and 11*d* is an outside view of an unrolled arm cuff. These figures show additional features of the arm cuffs, including rivets 121 that secure the arm cuff to the arm rest plate 120 on which it is mounted and a plurality of rectangular D-rings 136 configured to receive the free end or strap of the arm cuff to close the circle to apply compressive pressure to keep the upper arm (limb) immobile in relation to the beam 102.

Suitable materials for the straps 122 or cuffs include nylon webbing 152 over denier nylon 150 and binding tape 154 but other materials known in the art may also be used. For added comfort a foam layer or insert may be provided underneath the nylon. The appropriate rectangular D-ring 136 may be selected based on the diameter of the arm that has to be fit within the arm strap 122 or cuff. The rectangular D-rings may be semi-rectangular so that the strap or cuff lies flat after passing through one of them. The rectangular D-rings may be formed of plastic but other materials known in the art may also be used.

The strap 122 or cuff includes a male segment of material 138 configured to engage with a female segment of material 139 to fix the size or diameter of the arm strap or cuff. For example, VELCRO (registered trademark of Velcro Industries B.V. LLC NETHERLANDS ANTIL Castorweg 22-24 Curacao) is one specific type of fastener material that may be used to secure the arm cuff. According to one of several embodiments the male segment of material is narrower than the female segment of material, which allows it to fit easily through the substantially rectangular shape of the rectangular D-ring. The size and shape of the rectangular D-ring together with the varying width of the male and female segments distinguish between the male and female segments so that the female segment on the base of the strap or cuff cannot pass through the rectangular D-ring while the male segment readily slides through the rectangular D-ring.

The therapy apparatus 100 can be formed of any suitable material strong enough to handle the pressures exerted on it by relatively strong users. According to one embodiment the apparatus is formed of a light-weight aluminum construction. According to some embodiments the bottom of the apparatus may be larger and heavier than the top of the apparatus and may be coated with a material that creates friction or traction with a surface upon which the apparatus rests to prevent it from slipping, sliding, or tipping over. Alternatively, the apparatus may be mounted upon or within a separate base that is larger, heavier, and composed of or covered with rubber or a rubber-like material to provide traction against a mounting surface (not shown).

The apparatus and method enable a user to single-handedly self-direct therapy without assistance required to operate the apparatus. With the apparatus the user is able to manipulate connective tissue in a more dynamic manner, making progressive adjustments as appropriate to deepen the stretch.

A basic method of using the apparatus to restore range of motion of a limb may begin in any one of a number of manners as the order of steps is not critical and there are multiple possibilities that will work. The method involves positioning a joint of a limb into a joint rest disposed along the beam. A proximal region of the limb is secured to a proximal region of the beam. The handle disposed on the distal end of the cord through the beam is grasped with an extremity, such as a hand or a foot, at the distal end of the limb. A proximal end of the cord is manipulated to set a desired level of tension. The cord is automatically clamped in place at the desired level of tension by the ratchet clamp. Finally, to accomplish the stretch and exercise with the set-up in place, the user pulls the handle with the hand or foot against the resistance created by the clamped cord. When done, the user releases the ratchet clamp with a single hand and the tension of the tension cord is dissipated.

The apparatus of the preferred embodiment is easy to use and understand without complicated gears or springs and does not require electricity or batteries to operate. Further, it does not take up much space since it has a telescopic feature and is formed in this embodiment of a straight base that can be telescopically retracted on itself for transport and storage.

An embodiment of a ratchet clamp for securing the position of the cord is shown but changes and alterations may be made. The present design is particularly useful in that the entire therapy may be handled with only two hands. According to one embodiment, the clamp mechanism is a simple lever that can be pulled to press the cord against an inner wall of the beam 104, preventing it from moving freely into and out of the beam. The cord ratchet clamp should be positioned in a manner such that it does not interfere with placement of the apparatus on a flat mounting surface or within a base on a flat mounting surface. For example, alternatives include placing the clamp mechanism on a left or right side wall of the beam or possibly on top of the beam, rather than on the bottom surface of the beam.

The terms "a," "an," "the" and similar referents used in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Certain embodiments of this invention are described herein, including the best mode known to the inventors for carrying out the invention. Variations on these described embodiments may become apparent to those of ordinary skill in the art upon reading the foregoing description. The inventor expects skilled artisans to employ such variations as appropriate, and the inventors intend for the invention to be practiced otherwise than specifically described herein in preferred embodiments. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A therapy apparatus for restoring range of motion of a limb about a joint, the limb having a proximal segment on one side of the joint that connects the joint to a body of a user and a distal segment on another side of the joint that is movable in relation to the joint, with an extremity at a distal end of the distal segment of the limb, the apparatus comprising:

an elongated beam having a proximal end and a distal end, a top and a bottom, a length, and an inside, the bottom being flat;

a joint rest located on the top of the beam, configured to receive a joint of a user;

a limb segment rest formed on the top of the beam at a location proximal to the joint rest;

a limb strap mounted with the limb segment rest having a size long enough to engage and immobilize a proximal segment of a limb in the limb segment rest;

a cord having a thickness, a proximal end and a distal end, the cord slidably disposed within the beam, the cord extending through the beam with its distal end extending beyond the distal end of the beam, the cord having a length that is greater than the length of the elongated beam such that at the same time that the cord's distal end extends beyond the distal end of the elongated beam, the proximal end of the cord also extends beyond the proximal end of the beam;

an extremity-securing device attached to the distal end of the cord that moves with the cord towards and away from the distal end of the beam, the extremity-securing device configured to engage an extremity of a user that is part of a limb having a joint in the joint rest so that the engaged extremity is pulled towards the distal end of the elongated beam by pulling the cord in a proximal direction; and a ratchet clamp forming a part of the beam and configured to clamp the cord in a selected position in relation to the beam to thereby hold the extremity-securing device and an extremity engaging that device in a selected position under tension.

2. The therapy apparatus of claim 1 wherein the ratchet clamp is oriented within the elongated beam such that it resists movement of the cord in a distal direction and permits movement of the cord in the proximal direction.

3. The therapy apparatus of claim 2 wherein the ratchet clamp comprises a lever mounted on the beam with a pivot, at a first side of the pivot the lever has a handle portion extending outside the beam for manipulation by a user to release the clamp, and a clamp portion at an opposite side of the pivot having a clearance with the inside of the beam that is less than the thickness of the cord, the lever being oriented within the beam wherein it rotates the clamp portion in the proximal direction when the cord is pulled in the proximal direction thereby permitting the cord to be freely pulled in the proximal direction, and when the cord is pulled in the distal direction, the lever is configured to engage the cord and rotates the clamp portion towards the top of the beam thereby clamping the cord against the inside surface of the beam to resist movement of the cord in the distal direction.

4. The therapy apparatus of claim 3 wherein the clamp portion of the lever has a roughened surface to facilitate clamping engagement of the ratchet clamp with the cord.

5. The therapy apparatus of claim 1 wherein the joint rest is slidably mounted to the beam whereby users having arms of different lengths can be accommodated by the apparatus.

6. The therapy apparatus of claim 3 wherein the extremity-securing device comprises a rotatable handle thereby permitting an extremity of a user to grip the handle in a plurality of orientations.

7. The therapy apparatus of claim 1 wherein the elongated beam has a first segment and a second segment with the second segment being slidably and telescopically disposed within the first segment, whereby the second segment of the elongated beam is telescopically extendable and retractable in relation to the first beam segment.

8. The therapy apparatus of claim 7 further comprising a locking device located in connection with the first and second beam segments to lock the segments in a selected position in relation to each other.

9. The therapy apparatus of claim 8 further comprising a telescopic locking system having:

a movable pin biased to extend outwardly from the second beam segment;

a plurality of holes formed along a length of the first beam segment, each hole having an opening large enough to receive the movable pin;

whereby the first and second beam segments are movable in relation to each other to one of a plurality of positions at which the movable pin is biased into a hole, thereby locking the second segment into a selected amount of telescopic extension or retraction in relation to the first segment.

10. The therapy apparatus of claim 7 further comprising a relative position retainer disposed in a space between the first beam segment and the second beam segment, the position retainer having a thickness at least as large as the space whereby the position retainer exerts pressure on both the first beam segment and the second beam segment to hold them in a selected relative position to each other.

11. The therapy apparatus of claim 1 wherein:

the joint rest has a size and shape configured to receive an elbow of a user;

the limb segment rest has a size and shape configured to receive an upper arm of a user;

the limb strap has a length and shape configured to be placed around and immobilize the upper arm of a user in the limb segment rest; and the extremity-securing device comprises a rotatable handle having a size and shape configured to be firmly grasped by a hand of a user at a selected angle with the elbow.

12. A therapy apparatus for restoring range of motion of an arm about an elbow, the arm having an upper arm on one side of the elbow that connects the elbow to a body of a user and a forearm on another side of the elbow that is movable in relation to the elbow, with a hand at a distal end of the forearm, the apparatus comprising:

an elongated beam having a proximal end and a distal end, a top and a bottom, a length, and an inside, the bottom being flat;

an elbow rest located on the top of the beam, configured to receive an elbow of a user;

an upper arm rest formed on the top of the beam at a location proximal to the elbow rest;

an upper arm strap mounted with the upper arm rest having a size long enough to engage and immobilize the upper arm in the upper arm rest;

a cord having a thickness, a proximal end and a distal end, the cord slidably disposed within the beam, the cord extending through the beam with its distal end extending beyond the distal end of the beam, the cord having a length that is greater than the length of the elongated beam such that at the same time that the cord's distal end extends beyond the distal end of the elongated beam, the proximal end of the cord also extends beyond the proximal end of the beam;

a handle attached to the distal end of the cord that moves with the cord towards and away from the distal end of the beam, the handle configured to engage a hand of a user so that the hand is pulled towards the distal end of the elongated beam by pulling the cord in a proximal direction; and a ratchet clamp forming a part of the beam and configured to clamp the cord in a selected position in relation to the beam to thereby hold the handle and a hand engaging the handle in a selected position under tension, the ratchet clamp being oriented within the elongated beam such that it resists movement of the cord in a distal direction and permits movement of the cord in the proximal direction, wherein only one hand is needed to tighten the cord against the handle that has been engaged by a user's hand;

wherein the ratchet clamp comprises a lever mounted on the beam with a pivot, at a first side of the pivot the lever has a handle portion extending outside the beam for manipulation by a user to release the clamp, and a clamp portion at an opposite side of the pivot having a clearance with the inside of the beam that is less than the thickness of the cord, the lever being oriented within the beam wherein it rotates the clamp portion in the proximal direction when the cord is pulled in the proximal direction thereby permitting the cord to be freely pulled in the proximal direction, and when the cord is pulled in the distal direction, the lever is configured to engage the cord and rotates towards the top of the beam thereby clamping the cord against the inside of the beam to resist movement of the cord in the distal direction.

13. The therapy apparatus of claim 12 wherein:

the clamp portion of the lever is mounted to the pivot so that it is moved in the proximal direction;

the handle portion of the lever is mounted to the pivot so that it is moved in the distal direction;

wherein as the lever handle portion is pulled in the distal direction it forces the clamp portion to move in the proximal direction thereby releasing the cord from being clamped.

14. The therapy apparatus of claim 12 wherein the joint rest is slidably mounted to the beam whereby users having arms of different lengths can be accommodated by the apparatus.

15. The therapy apparatus of claim 12 wherein the elongated beam has a first segment and a second segment with the second segment being slidably and telescopically disposed within the first segment, whereby the second segment of the elongated beam is telescopically extendable and retractable in relation to the first beam segment.

16. The therapy apparatus of claim 15 further comprising a locking device located in connection with the first and second beam segments to lock the segments in a selected position in relation to each other.

17. The therapy apparatus of claim 16 further comprising a telescopic locking system having:

a movable pin biased to extend outwardly from the second beam segment;

a plurality of holes formed along a length of the first beam segment, each hole having an opening large enough to receive the movable pin;

whereby the first and second beam segments are movable in relation to each other to one of a plurality of positions at which the movable pin is biased into a hole, thereby locking the second segment into a selected amount of telescopic extension or retraction in relation to the first segment.

18. The therapy apparatus of claim 15 further comprising a relative position retainer disposed in a space between the first beam segment and the second beam segment, the position retainer having a thickness at least as large as the space whereby the position retainer exerts pressure on both the first beam segment and the second beam segment to hold them in a selected relative position to each other.

* * * * *